United States Patent [19]

Kobler et al.

[11] 4,307,362

[45] Dec. 22, 1981

[54] ELECTROMAGNETIC RELAY

[75] Inventors: Ulrich Kobler, Munich; Eberhard Wanka, Dachau, both of Fed. Rep. of Germany

[73] Assignee: Siemens Aktiengesellschaft, Berlin & Munich, Fed. Rep. of Germany

[21] Appl. No.: 126,709

[22] Filed: Mar. 3, 1980

Related U.S. Application Data

[63] Continuation of Ser. No. 905,976, May 15, 1978.

[30] Foreign Application Priority Data

May 24, 1977 [DE] Fed. Rep. of Germany ..... 2723430

[51] Int. Cl.[3] ..... H01H 45/02

[52] U.S. Cl. ..... 335/202; 335/128

[58] Field of Search ..... 335/202, 162, 278, 292, 335/294, 128

[56] References Cited

U.S. PATENT DOCUMENTS

| | | | |
|---|---|---|---|
| 3,516,035 | 6/1970 | Josenhans | 335/202 |
| 3,668,578 | 6/1972 | Schroeder | 335/202 |
| 3,993,971 | 11/1976 | Ono et al. | 335/202 |

*Primary Examiner*—Harold Broome

*Attorney, Agent, or Firm*—Hill, Van Santen, Steadman, Chiara & Simpson

[57] ABSTRACT

An electromagnetic relay is provided in which the housing therefor is divided into two space areas, namely, one for the contacts, which is sealed off from a coil space area. The contact space is substantially sealed from the coil winding by having the carrier for the movable armature, the movable contacts and the stationary contacts on one side of a base body, and the coil on the other side. The contact area is provided by the base body and a protective cap. Stationary contact terminals are embedded in the wall of the base body. Spring biased movable contacts are mounted in the contact space. The protective cap closely adjoins the base body. The coil has a ferromagnetic core which at opposite ends of the coil have uprising flanges which form pole shoes. These flanges extend through openings in the base body in proximity to the armature. A permanent magnet means is also located in the contact space area in proximity to the pole shoes so when the coil is energized the carrier is shifted from one position to another to open and close switch contacts. The flanges are sealed to the base body and act as the supporting means for the coil.

10 Claims, 11 Drawing Figures

ELECTROMAGNETIC RELAY

This is a continuation of application Ser. No. 905,976, filed May 15, 1978.

BACKGROUND OF THE INVENTION

The invention relates to an electromagnetic relay comprising a base body which includes a contact space which is closed by a protective cap, and a coil which is arranged beneath the contact space towards the terminal side, and comprising an insulating carrier which is arranged between the coil and the contact space and is provided for the armature arranged in the contact space.

In a known relay of this type (German AS No. 24 54 967, corresponding to U.S. Pat. No. 3,993,971), a coil body is provided into which contact carriers can be inserted on both sides of the winding; furthermore, a bearing plate for the armature is arranged on the winding. Thus, with this construction, it is necessary to produce and assemble a relatively large number of individual components which furthermore results in an undesired adding up of tolerance. This is because, between the contact elements and the armature, the tolerances of the armature, from the armature to the bearing plate, from the bearing plate to the coil body and from the coil body to the contact carriers are added up. Furthermore, the bearing plate does not fully seal the contact space from the coil winding and any harmful evaporation thereof, unless the coil body and the contact elements are commonly cast in an additional operating process.

The aim of the present invention is to provide a relay of the type mentioned above, in such a manner that the contact space is substantially sealed from the coil winding; this relay may be produced with the least possible number of individual parts and the least possible number of operating processes.

BRIEF SUMMARY OF THE INVENTION

In accordance with the present invention, this aim is achieved in that the carrier for the armature on the one side and for the coil on the opposite side consists of a base body having embedded contact terminal elements, which body closely adjoins the protective cap all around and is merely provided with ducts for two yoke flanges which bear the coil at the core ends.

The base body provided in accordance with the present invention not only forms a substantially impervious partition wall between contact space and coil space, but also serves as carrier for all the relay components unless they are anyhow directly embedded in the base body. Additions of tolerances are largely avoided as the contact elements are cast in the base body and thus can be directly dimensioned during the casting process to form a molded on armature bearing and the ducts of the yoke flanges. Within the yoke ducts there is expediently provided a side wall as dimensionally accurate bearing surface with precisely dimensioned spacings from the other function elements.

In an advantageous further embodiment, the base body is provided with at least two side walls which at least partially enclose the coil so that is possesses a U-shaped cross-section. If side walls of this type continue all around, the base body appears as an inverted trough which encloses the coil. In specific cases, it can be favorable to carry out the production by assembling the base body from two parts each with a cast-in row of contact terminal elements. In a further embodiment, this base body can be additionally provided with side walls which enclose the contact space, forming an approximately H-shaped cross-section. In this, the contact space could be sealed by means of a disc-shaped cover which can be produced most simply merely by punching.

In an expedient embodiment of the invention, it is provided that the contact terminal elements are embedded in those side walls of the base body which surround the coil space. This produces relatively long embedding length and a good seal of the contact ducts between terminal side and contact space. Furthermore, coil terminal elements can be embedded into the base body and connected to the winding terminals in the region of the coil space. It is particularly advantageous if a lug split off from the coil terminal elements emerging from the base body is in each case bent over and connected to the winding terminals by soldering or welding. However, the lug can also be cut off so that the particular winding terminal can be welded onto the end-side sectional surface of the terminal element.

In an expedient embodiment, the coil space which is entirely surrounded with side walls is filled with sealing compound. This sealing compound not only additionally seals the ducts of the yoke flanges in the base body, but also ensures a good discharge of the winding heat to the exterior, and fundamentally increases the stability of the relay. In this case, it is particularly advantageous for the protective cap to completely laterally engage over the base body so that both the coil space and the gap between base body and protective cap are sealed in one single process. The long sealing length between base body and protective cap also protects the contact space in an outstanding fashion from environmental influences. Expediently, the base body possesses a lateral groove so that the insulating compound which is caused to rise by the capillary action between the base body and the protective cap cannot penetrate into the contact space.

As stated, in a relay in accordance with the invention, the coil is wound separately from the base body and only then connected to the latter via the yoke flanges. Here the coil body is expediently designed in such a manner that its flanges at least partially enclose the relevent yoke flanks and form sealing surface, which contact the base body, beside the ducts of the yoke flanges. This prevents sealing compound from reaching the contact space during the process of sealing of the coil space. In a special embodiment, the coil flanges can engage by projections into stepped recesses of the base body. A particularly effective sealing of the coil flanges around the yoke flanges is achieved when these form one component with the coil core and are embedded into the body by casting. In the contact space, a bearing element for the armature, for example a bearing pin for a rotary armature, is expediently molded onto the base body, this bearing element being arranged at a precise distance from the ducts of the yoke flanges. In a polarized embodiment of the relay, the ends of the two yoke flanges, which lead into the contact space, can be connected to one another via a three-pole rod magnet, in front of the central pole of which there is mounted a rotary armature. In a further embodiment, the rotary armature bears an actuation plate which is parallel to its movement plane. This actuation plate can, for example, be connected to the armature by casting with synthetic material, and can also be provided with cast-on actuating pins. Other known magnet systems and armature forms can also be employed on the base body and, in accordance with the purposes of use, form a monostable or bistable, polarized or non-polarized relay.

BRIEF DESCRIPTION OF THE DRAWINGS

In the following the invention will be explained in the form of exemplary embodiments, making reference to the drawing, in which.

DESCRIPTION OF THE PREFERRED EMBODIMENTS

Figure 1:
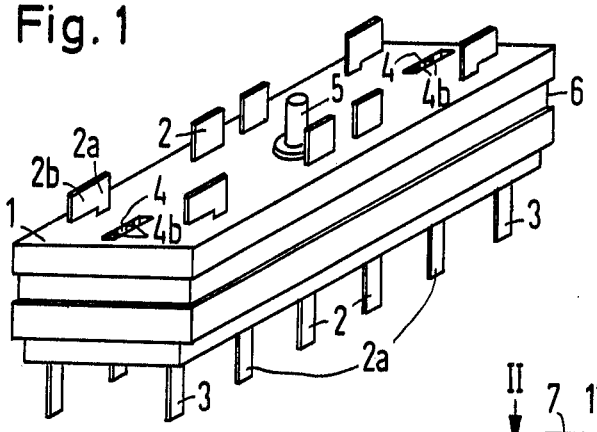
FIG. 1 illustrates a one-part relay base body in the form of a trough which is open underneath.

FIG. 1 illustrates a relay base body 1 consisting of insulating material in the form of a trough which is open underneath. Two rows of terminal elements, i.e., contact terminal elements 2 and 2*a* and coil terminal elements 3 are cast into the base body. Two openings 4 for the accommodation of yoke flanks are also provided. On the upper side, a bearing pin 5 for a rotary-armature is also molded on centrally. On the outer walls, the base body 1 is provided with a circular groove 6 for the accommodation of casting resin which penetrates into the capillary gap between the base body and an inverted protective cap.

Figure 3:
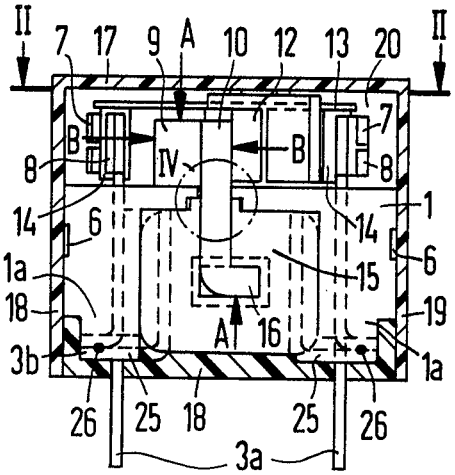
FIG. 3 is a sectional view III—III from FIG. 2.
Figure 2:
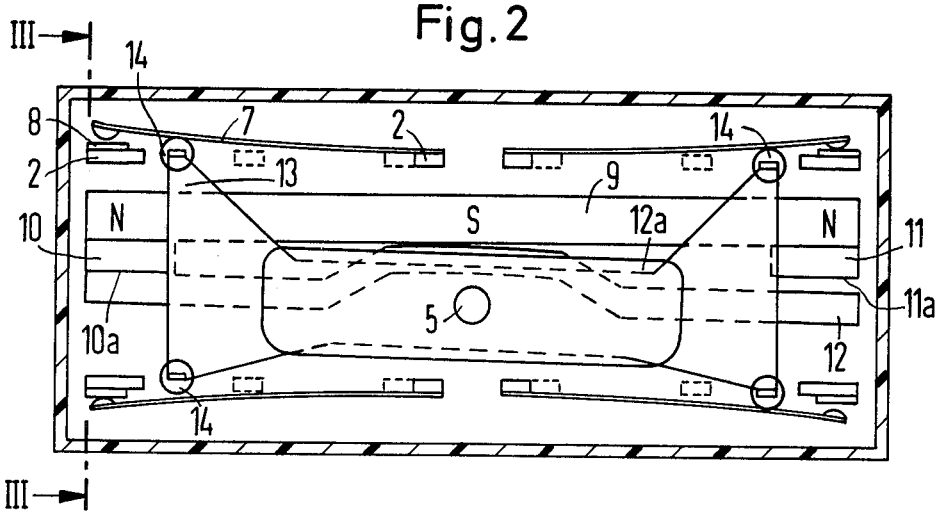
FIG. 2 is a view of the contact space from above with the protective cap cut open, taken along line II—II of FIG. 3.

FIGS. 2 and 3 illustrate a relay completely assembled on the base body of FIG. 1. The contact elements 2 which have been diecast into the base body 1 are provided with contact springs 7, and the contact elements 2*a* serve as counter-contacts with contact bearings 8 which are provided on adjusting lugs which have been cut free. The illustrated polarized magnet system possesses a three-pole rod magnet 9 which at its ends is secured, for example welded, in each case to the end of a yoke flange 10, 11. The armature 12 is partially cast with synthetic material and a bearing for the bearing pin 5 is also provided in this synthetic casing 12*a*. The contact actuation is effected with an actuating plate 13 which is welded onto the armature and which, with the armature, is partially encased with synthetic material. Actuating pins 14 consisting of synthetic material are cast onto the corners of the actuating plate which face towards the contact springs.

It can be seen from the end view of the base body 1 in FIG. 3, that the coil flange 15 is inserted into the trough form of the base body so that it is surrounded by the latter on three sides. The coil core 16 is embedded, for example, into the coil body by die casting. In order that the coil and the relay have the least possible structural height, the coil core is arranged with its flat side parallel to the terminal side of the relay, and the yoke flanges 10 and 11 which, with the core consist of one component, at the coil ends are bent laterally upwards. The yoke flanges 10 and 11 are surrounded on three sides by the coil flange 15 so that coil flange and yoke flange form a flat sealing surface at the end side. The entire relay is sealed with a protective cap 17 which engages over the base body 1 towards the terminal side. The open side of the protective cap is filled with sealing compound 18 which fills the entire cavity between base body and coil and additionally seals the die-cast terminal pins 2. Between the base body 1 and the protective cap 17, a relatively deep capillary gap 19 ensures a good sealing of the contact space. In order to prevent the sealing compound 19 from flowing through to the contact space 20, the capillary gap 19 is interrupted by the circular groove 6 in the base body.

In the assembly of the magnet system in the base body 1, the coil is inserted from below, and the two yoke flanges 10 and 11 are passed through the ducts 4 of the base body 1. Then the permanent magnet 9 and the two parts are pressed against one another in the vertical direction (arrows A) and in the horizontal direction (arrows B) and are welded. In this way, a position stability of the pole faces 10*a* and 11*a* which is adequate for adjustment is achieved.

Figure 4:
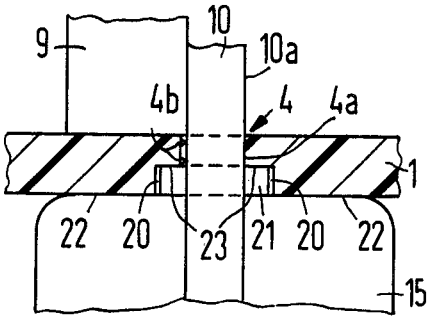
FIG. 4 illustrates an enlarged extract IV from FIG. 3.

FIG. 4 is an enlarged detailed view of the passage of the yoke flanges 10 and 11 in the basic body 1. The ducts 4 illustrated in FIG. 1 are each provided with a bearing surface 4*a* for the pole face 10*a* and 11*a* of the relevant yoke flange 10 or 11. This bearing surface 4*a* is dimensionally accurately spaced from the bearing pin 5 for the armature. Ribs 4*b* which lie opposite the bearing surfaces 4*a* are also provided in the openings 4. These ribs can be deformed when the yoke flanges are impressed and thus press the yoke flanges without play against the bearing surfaces 4*a*. In order to seal the duct, the opening 4 is provided with a stepped recess 20 into which engages a projection 21 of the coil flange. As the coil flange partially embraces the yoke flange 10, the seal can be provided between the coil flange and the basic body, and in fact on the horizontal sealing surfaces 22 or 23 of the coil flange 15 and the projection 21. Any casting resin which may flow through can be collected behind the sealing surfaces in the recess 20 and in the opening 4. These recesses have no capillary action, and therefore, do not draw any more casting resin.

Figure 5:
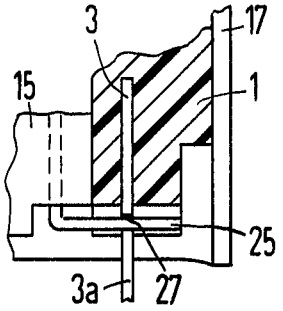
FIG. 5 illustrates a detail from FIG. 3.
Figure 6:
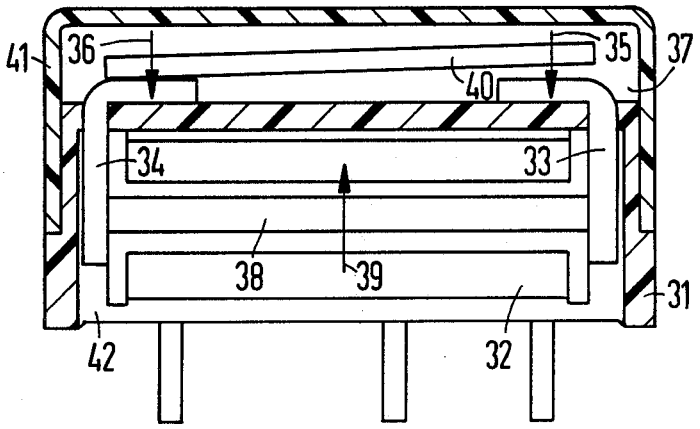
FIGS. 6 and 7 illustrate a further embodiment in a schematic illustration with a one-part base body.

FIG. 3 also illustrates the connection of the coil ends to the terminal elements 3 cast into the basic body. The relevent terminal element 3 is split at its free end into a terminal lug 3*a* and a connection lug 3*b* bent at right angles. The winding terminal 25 likewise bent at right angles is applied to this connection lug 3*b* and welded or soldered at the point 26. This connection point lies inside the space enclosed by the protection cap 17 and filled with sealing compound 18. FIG. 5 shows a detailed extract of a modified design of the coil terminal. Here the bent over connection lug 3*b* has been omitted. The coil terminal element 3 is merely cut away at right angles forming the terminal lug 3*b*. The winding terminal 25 is pressed at the end side against the sectional surface 27 and welded.

Figure 7:
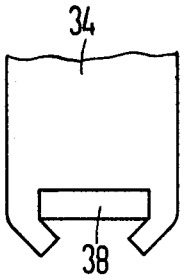

FIGS. 6 to 11 are simplifed views of further embodiments of the base body. FIG. 6 again shows a one-part trough-shaped base body 31 which surrounds the coil 32. In this case, the yokes 33 and 34 are angular and are introduced in the direction of the arrows 35 and 36 from the contact space 37 through openings in the base body 31 into the coil space. The coil, with the core 38, is inserted from below (arrow 39) and then the core 38 with the yoke angles 33 and 34 is notched as illustrated in FIG. 7. A schematically illustrated flat armature 40 can be arranged on the yoke angles 33 and 34. The contact space 37 is closed by a protective cap 41, whereas the coil space is sealed with sealing compound 42.

Figure 8:
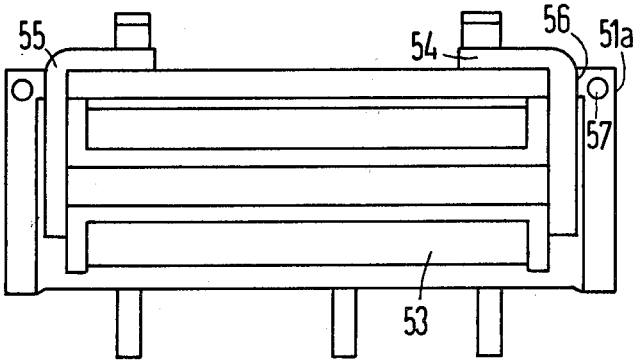
FIGS. 8 and 9 illustrate a further embodiment with a base body composed of two parts.
Figure 9:
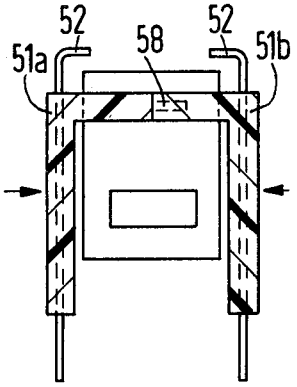

A further possibility of mounting angular yokes in the base body is shown in FIGS. 8 and 9. Here the base body 51 consists of two halves 51*a* and 51*b*, each of which contains a series of die-cast terminal elements 52. The yokes 54 and 55, which are connected to the coil 53, are clamped into recesses 56 when the two halves of the base body 51*a* and 51*b* are assembled. Pins 57 and bores 58 can be provided, for example, to achieve a force- and shape-locking connection of the two halves of the base body.

Figure 10:
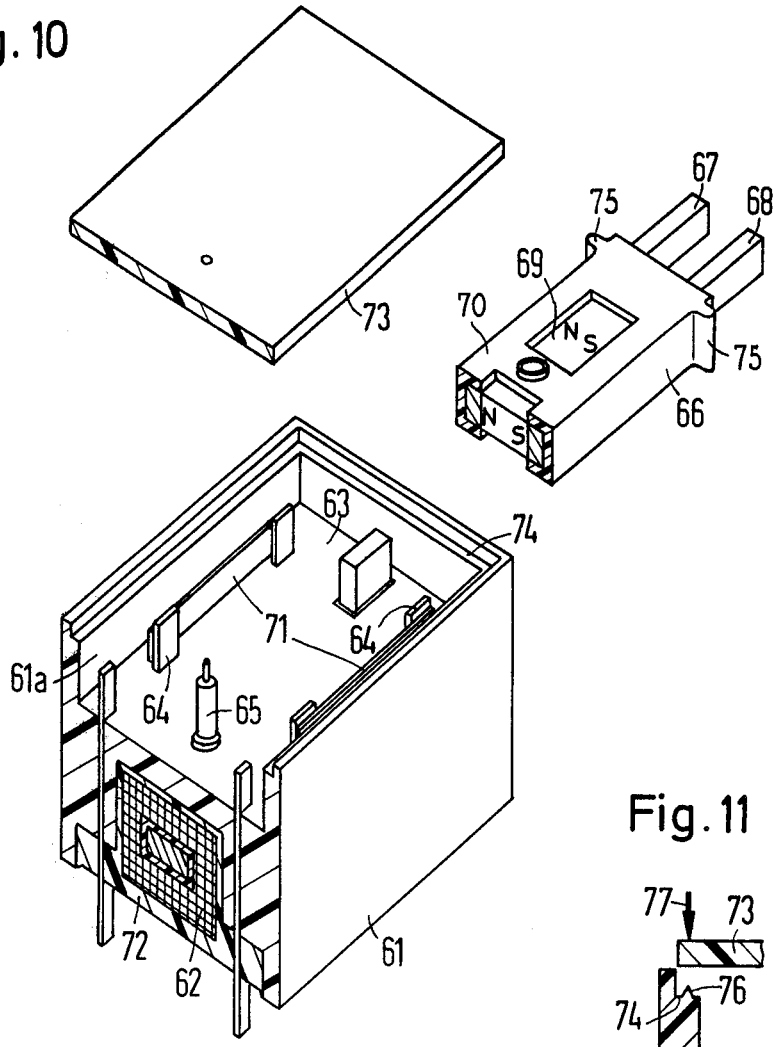
FIGS. 10 and 11 show a further variant with a base body which additionally surrounds the contact space.

FIG. 10 shows another embodiment of the base body. This base body 61 encloses not only the coil 62 in the form of a trough, but also the contact space 63 forming an approximately H-shaped cross-section. As in FIGS. 1 to 3, the base body 61 also bears embedded terminal elements 64 and a molded on bearing pin 65 for a rotary armature. The latter can be designed as H-armature 66 which contains a permanent magnet 69 between two ferromagnetic arms 67 and 68. The two ferromagnetic arms 67 and 68 can be provided with a synthetic casing 70 and with actuating projections 75 for the contact spring 71. Naturally, here again, any other magnet system having a suitable armature can be used.

Figure 11:
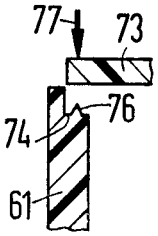

As in the previous examples, the coil space is filled with sealing compound 72, whereas the contact space 63 is sealed in simple fashion by a flat cover 73. This cover can be formed by punching out a flat foil and can be sealed in a suitable fashion on the recessed edge 74 of the base body 61. FIG. 11 illustrates a sealing possibility of this type. Here the recessed edge 74 of the base body 61 is provided with a rib 76. The cover can now be secured by ultrasonic welding, when a sonotrode presses in the direction of the arrow 77 onto the edge of the cover 73, which is imperviously welded to the basic body 61, deforming the rib 76.

It will be apparent to those skilled in the art that many modifications and variations may be effected without departing from the spirit and scope of the novel concepts of the present invention.

We claim as our invention:

1. An electromagnetic relay comprising:

a base body including walls defining a coil space in the form of a trough;

a protective cap tightly fitting said base body and defining, along with at least one of said walls, a contact space above the coil spaces;

a plurality of contact elements each including a first end comprising a relay contact and a second end comprising a terminal lug, said contact elements embedded in and extending through said base body with said first ends located in the contact space and the second ends extending from said base body;

an armature pivotally mounted in the contact space for operating the relay contacts;

a permanent magnet mounted in the contact space adjacent said armature;

means defining a pair of spaced ducts extending through said one wall;

coil means mounted in the coil space and including an elongate coil having coil terminals and a coil core including yoke flanges extending through said ducts in a sealed manner and secured to said permanent magnet;

terminal elements connected to said coil terminals and extending out of said base body; and a casting resin filling the interstices of the coil space including material drawn between said base body and said protective cap by capillary action.

2. The electromagnetic relay of claim 1, wherein said coil means comprises:

end flanges partially enclosing respective yoke flanges and contacting said base body adjacent said ducts.

3. The electromagnetic relay of claim 2, wherein said one wall includes stepped recesses adjacent said ducts and said coil end flanges include projections engaging in respective stepped recesses.

4. The electromagnetic relay of claim 1, comprising:

a bearing element integrally molded onto said one wall in the contact space and pivotally carrying said armature.

5. The electromagnetic relay of claim 1, wherein said permanent magnet is a three-pole rod magnet.

6. The electromagnetic relay of claim 1, wherein said armature includes an actuating plate extending parallel to the plane of movement of said armature.

7. The electromagnetic relay of claim 6, comprising:

a plurality of actuating pins of synthetic material carried by said actuating plate.

8. An electromagnetic relay comprising:

a base body including walls defining a coil spacing in the form of a first trough opening outwardly of said base body in a first direction and a contact space in the form of a second trough opening outwardly of said body in a second direction;

a protective cap tightly fitting said base body and secured thereto to close the contact space;

a plurality of contact elements each including a first end comprising a relay contact and a second end comprising a terminal lug, said contact elements embedded in and extending through said base body with said first ends located in the contact space and the second ends extending from said base body;

an armature pivotally mounted in the contact space for operating the relay contacts, said armature comprising a H-shape and including a permanent magnet mounted between a pair of ferromagnetic arms, and contact actuating elements for engaging at least some of said contact elements;

means defining a pair of spaced ducts extending through said base body between the coil space and the contact space;

coil means mounted in the coil space and including an elongate coil having coil terminals and a coil core including yoke flanges extending through said ducts in a sealed manner to locations adjacent said ferromagnetic arms;

terminal elements connected to said coil terminals and extending out of said base body; and a casting resin filling the interstices of the coil space.

9. The electromagnetic relay of claim 1, comprising:

a recessed edge on said base body for receiving siad protective cap.

10. The electromagnetic relay of claim 9, comprising a weld securing said protective cap in said recess.

* * * * *